US005584356A

United States Patent [19]

Goodrich

[11] Patent Number: 5,584,356

[45] Date of Patent: Dec. 17, 1996

[54] CENTERLINE DOUBLE RISER WITH SINGLE LIFT CYLINDER AND LINK FOR A LOW PROFILE SELF PROPELLED AERIAL WORK PLATFORM

[75] Inventor: Michael F. Goodrich, Myersville, Md.

[73] Assignee: Kidde Industries, Inc., Iselin, N.J.

[21] Appl. No.: 455,214

[22] Filed: May 31, 1995

[51] Int. Cl.[6] ..... B66F 11/04

[52] U.S. Cl. ..... 182/63; 182/2; 248/421

[58] Field of Search ..... 182/63, 2; 248/421, 248/370

[56] References Cited

U.S. PATENT DOCUMENTS

| | | | |
|---|---|---|---|
| 3,132,718 | 5/1964 | Pierce, Jr. | 182/63 |
| 3,483,948 | 12/1969 | Thornton-Trump | 182/2 |
| 3,554,319 | 1/1971 | Smith | 182/2 X |
| 3,768,591 | 10/1973 | Stucky et al. | 182/2 |
| 4,019,604 | 4/1977 | Benson | 182/2 |
| 4,053,075 | 10/1977 | Stedman | 182/2 X |
| 4,679,653 | 7/1987 | Pasquarette, Jr. et al. | 182/2 |
| 4,757,875 | 7/1988 | Hade, Jr. et al. | 182/2 |
| 4,953,666 | 9/1990 | Ridings | 187/9 |
| 5,129,480 | 7/1992 | Garrett et al. | 182/63 |
| 5,249,643 | 10/1993 | Backer et al. | 182/2 |
| 5,427,197 | 6/1995 | Waters | 182/63 X |

FOREIGN PATENT DOCUMENTS

| | | | |
|---|---|---|---|
| 4246098 | 9/1992 | Japan | 182/63 |

*Primary Examiner*—Carl D. Friedman
*Assistant Examiner*—Winnie Yip

[57] ABSTRACT

A vehicular low profile, self propelled aerial work platform having an articulated parallelogram boom assembly including a lower boom assembly having pairs of compression and tension arms pivotally connected between a support frame on the vehicle and a floating frame, and an upper boom assembly having pairs of compression and tension arms pivotally connected between the floating frame and a riser connected to the proximate end of a telescopic boom assembly having a work platform connected to the distal end thereof. The ends of the tension arms in the upper and lower boom assemblies which are pivotally connected to the floating frame, share the same pivot connection so that when the articulated parallelogram is in the folded position the tension arms are inter-digitated and lie in the same common plane so that the vehicle can be maneuvered through a low doorway, in the order of six feet, seven inches. A synchronization linkage is mounted in the floating frame and connected between the pairs of compression arms in the upper and lower boom assemblies for maintaining the floating frame in a vertical orientation during the elevating and folding of the articulated parallelogram boom assembly.

11 Claims, 9 Drawing Sheets

CENTERLINE DOUBLE RISER WITH SINGLE LIFT CYLINDER AND LINK FOR A LOW PROFILE SELF PROPELLED AERIAL WORK PLATFORM

BACKGROUND OF THE INVENTION

A vehicular low profile self propelled aerial work platform is disclosed in U.S. Pat. No. 4,757,875, owned by the Assignee of the instant application, wherein a work platform is mounted on the distal end of a telescopic boom assembly having its proximate end pivotally connected to a floating or riser frame assembly which, in turn, is connected to a support frame on the vehicle by a pair of parallel arms, whereby the telescopic boom assembly and associated work platform can be extended to an operative position and folded to a lowered position, so that the vehicle can be maneuvered in warehouses or manufacturing plants having nine foot high doorways.

An articulated parallelogram assembly for elevating a work platform is disclosed in U.S. Pat. No. 5,129,480, also owned by the Assignee of the instant application, wherein a lower boom assembly having parallel compression and tension arms, offset from the centerline of the vehicle, are pivotally connected between a floating or riser frame assembly and the vehicle frame. An upper boom assembly is also provided wherein parallel compression and tension arms, offset from the centerline of the vehicle, are pivotally connected between the platform frame and the floating frame.

While the self propelled aerial work platforms disclosed in the aforementioned patents have been satisfactory for their intended purposes, certain features contained in these self propelled aerial work platforms are employed in the low profile self propelled aerial work platform of the present invention to provide a new combination of components, whereby the telescopic boom assembly can be folded to a lowered position so that the vehicle can be maneuvered through standard height six foot, seven inch doorways.

SUMMARY OF THE INVENTION

The low profile self propelled aerial work platform of the present invention comprises, essentially, an articulated parallelogram boom assembly connected between a support frame on the vehicle and a riser at the proximate end portion of a telescopic boom assembly having a work platform on the distal end thereof. The parallelogram boom assembly includes a lower boom assembly having parallel compression and tension arms positioned substantially on the centerline of the vehicle and pivotally connected between the support frame on the vehicle and a floating frame or riser; and an upper boom assembly having compression and tension arms positioned substantially on the centerline of the vehicle and pivotally connected between the floating frame and the riser at the proximate end portion of the telescopic boom. The tension arms on the upper and lower boom assemblies share a common pivot connection on the floating frame so that the tension arms on the upper and lower boom assemblies inter-digitate and lie in the same common horizontal plane when the telescopic boom is lowered to the folded position, whereby the vehicle can be maneuvered in warehouses or manufacturing plants having standard height six foot, seven inch doorways. A single lift cylinder extends between the compression arms in the upper and lower boom assemblies for elevating and lowering the telescopic boom assembly.

DESCRIPTION OF THE PREFERRED EMBODIMENT

Figure 1:
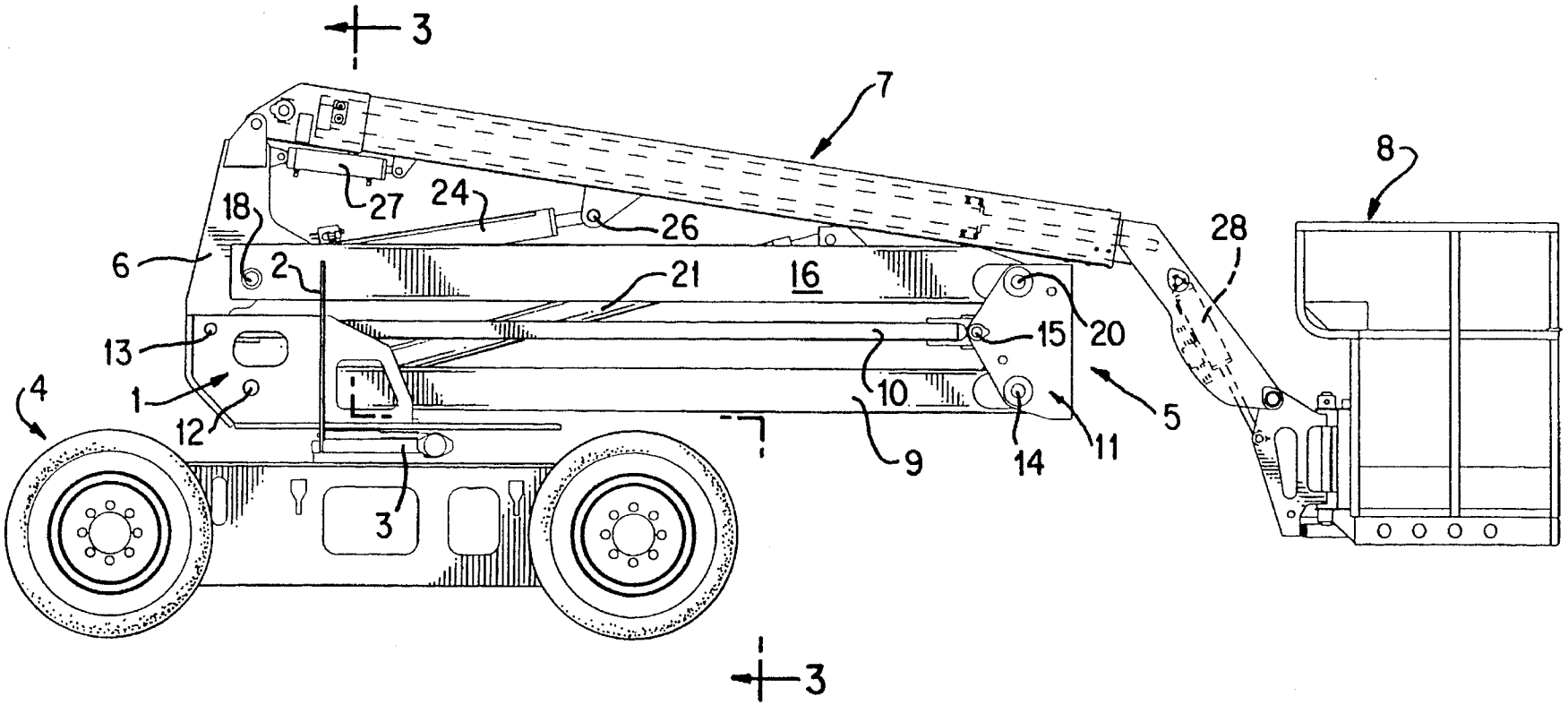
FIG. 1 is a side elevational view of a mobile aerial work platform showing the double parallelogram riser assembly according to the invention in a retracted position.
Figure 2:
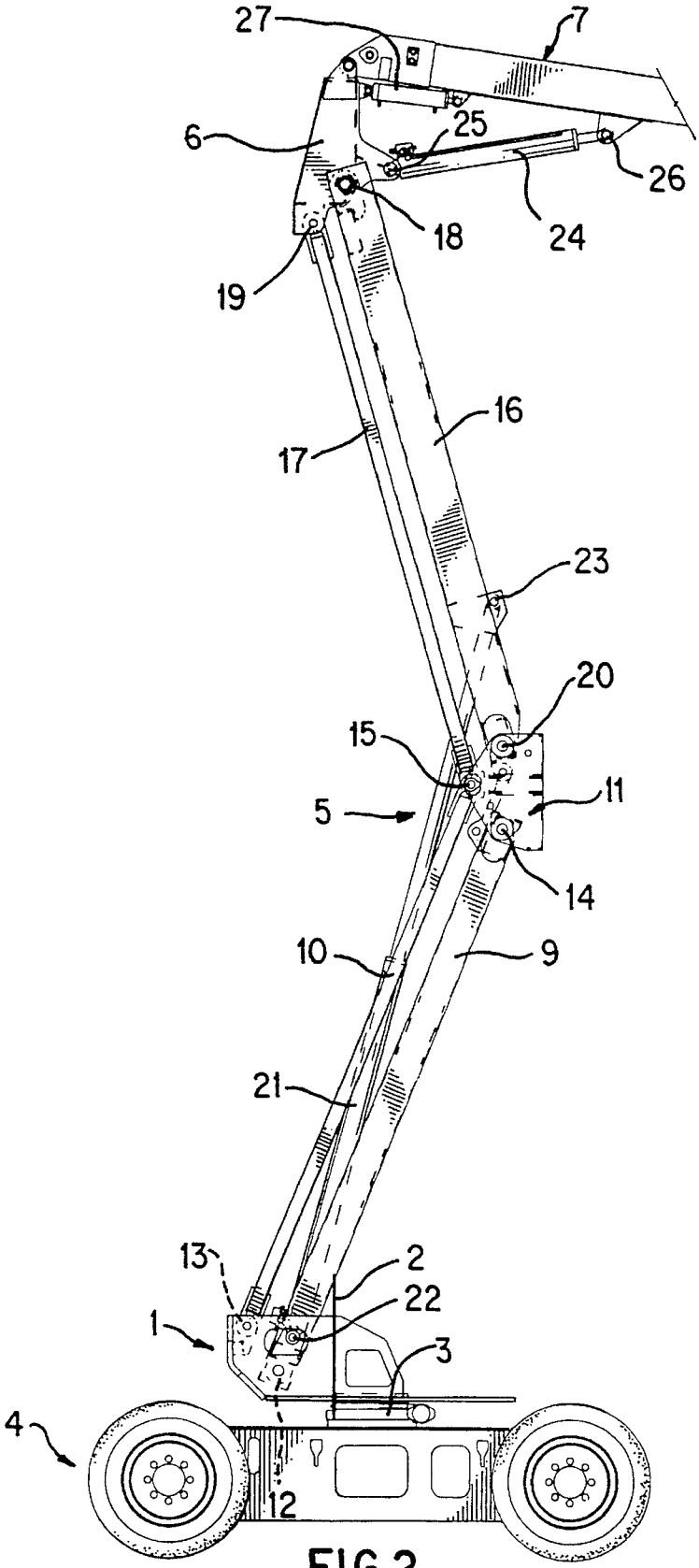
FIG. 2 is a side elevational view showing the double parallelogram riser assembly in an extended raised position.
Figure 3:
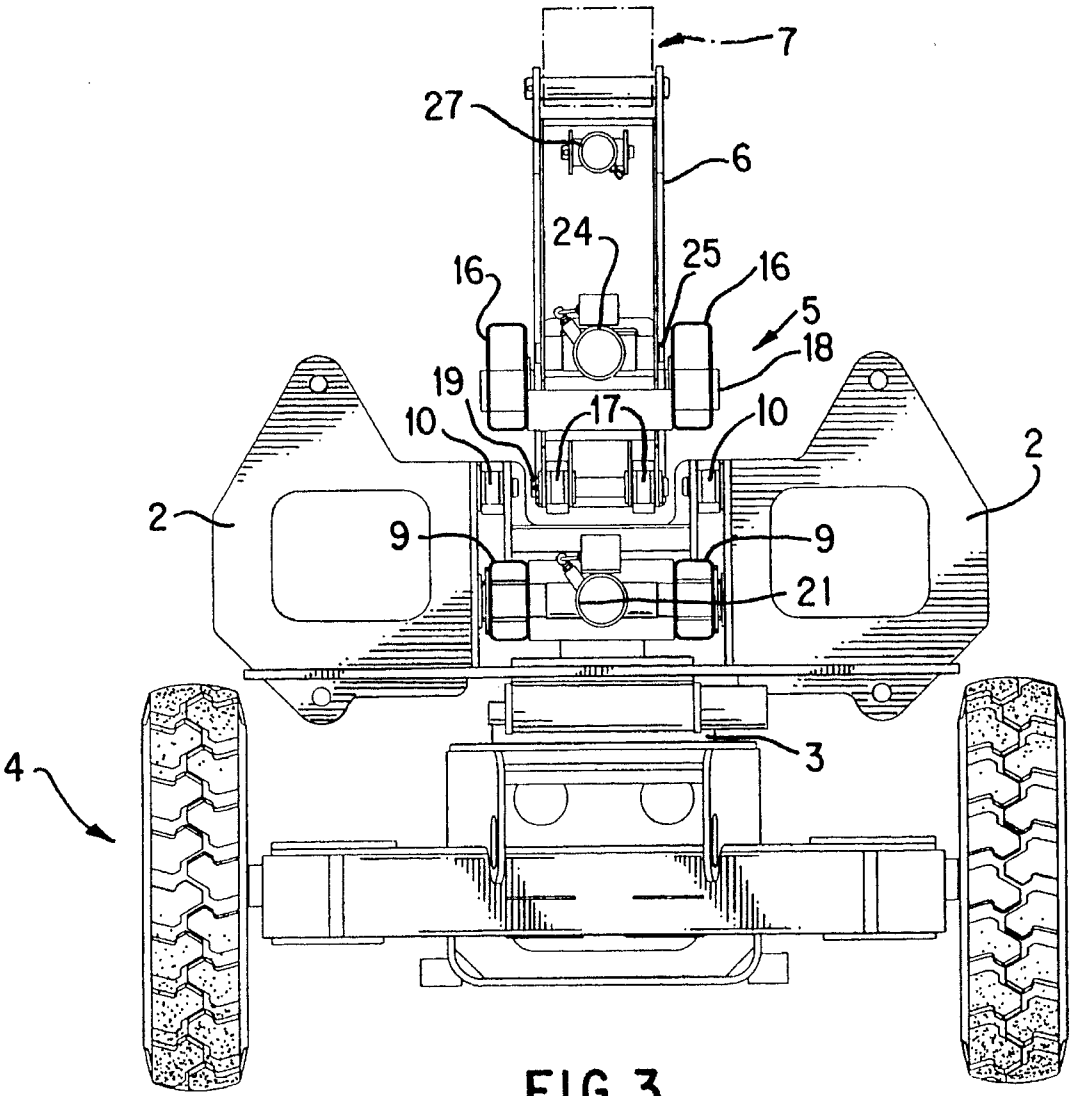
FIG. 3 is a front elevational view, partly in cross-section, taken substantially along line 3—3 of FIG. 1.

Referring to the drawings, and more particularly to FIGS. 1, 2 and 3, the low profile self propelled aerial work platform of the present invention comprises a superstructure support frame 1, having vertically extending plates 2 upon which counterweights, not shown, are adapted to be mounted; the support frame is mounted on a turntable 3 carried by a vehicle chassis 4. An articulated parallelogram boom assembly 5 is operatively connected between the support frame 1 and a riser 6 connected to the proximate end portion of telescopic boom assembly 7 having a work platform 8 mounted on the distal end thereof.

The articulated parallelogram boom assembly 5 includes a lower boom assembly having pairs of parallel, laterally spaced compression and tension arms 9 and 10, respectively, extending between the support frame 1 and a floating frame 11, the arms being pivotally connected to the support frame as at 12 and 13, and to the floating frame as at 14 and 15. The articulated parallelogram boom assembly 5 also includes an upper boom assembly having pairs of parallel, laterally spaced compression and tension arms 16 and 17, respectively, extending between the riser 6 and the floating frame 11, the arms 16 and 17 being pivotally connected to the riser as at 18 and 19, and to the floating frame 11, as at 20 and 15, which is the same pivot connection for tension arms 10 in the lower boom assembly.

An extensible hydraulic cylinder 21, positioned on the centerline of the machine, is pivotally connected as at 22 to and between the lower compression arms 9, and as at 23 to and between the upper compression arms 16, whereby, when the cylinder 21 is retracted, the parallelogram assembly 5 is in the folded position, as shown in FIG. 1, and is in the elevated position, as shown in FIG. 2, when the hydraulic cylinder 21 is extended.

A boom lift cylinder 24 is similarly pivotally connected along the centerline of the machine, above cylinder 21, between the riser 6, as at 25, and the telescopic boom assembly 7, as at 26. The remaining components on the telescopic boom assembly 7 are conventional and include a master hydraulic cylinder 27 for controlling a slave cylinder 28 on the distal end of the telescopic boom assembly 7 for maintaining the work platform 8 in a horizontal position during the raising and lowering of the parallelogram assembly 5 and the luffing of the telescopic boom assembly 7 with boom lift cylinder 24. In the folded or retracted position of the parallelogram assembly 5, cylinder 21 is nested between the pairs of arms 9, 17 and 16, and boom lift cylinder 24 is nested between arms 16, above cylinder 21, and master hydraulic cylinder 27, as well as the cylinder inside the telescopic boom assembly 7 for extending and retracting the same are positioned above the other cylinders on the centerline of the machine.

Figure 7:
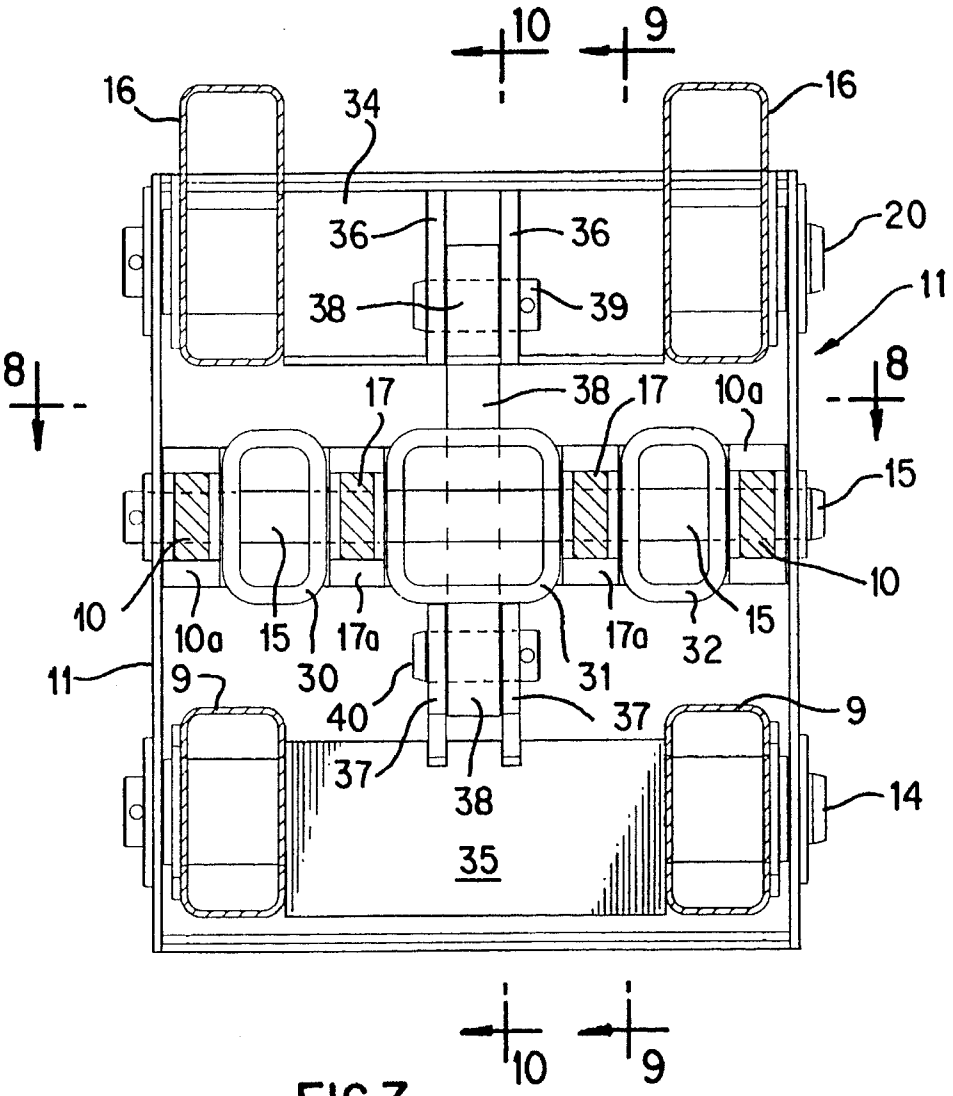
FIG. 7 is an enlarged cross-sectional view taken substantially along line 7—7 of FIG. 4.
Figure 8:
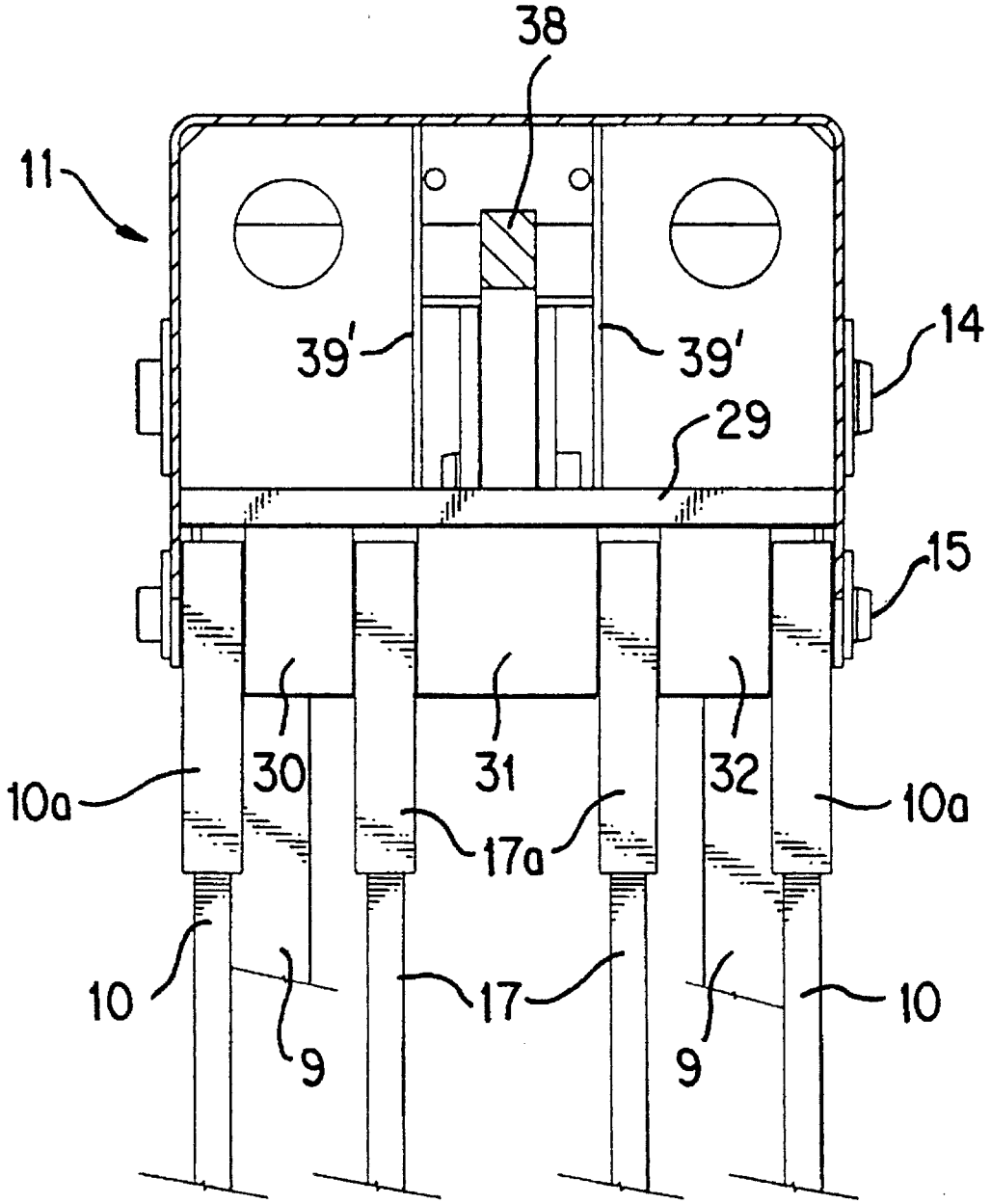
FIG. 8 horizontal sectional view taken substantially along line 8—8 of FIG. 7.

FIGS. 7 and 8 illustrate the details of the common pivot connection 15 between the tension arms 10 and 17 at the floating frame 11 wherein it will be seen that a transversely extending plate 29 is integral with the side walls of the floating frame 11 and has a plurality of spaced, short tubular members 30, 31, 32 integral with the plate 29 and extending outwardly therefrom. Each of the tension arms 10 and 17 are provided with enlarged portions 10*a* and 17*a* which extend into the respective spaces between the tubular members 30, 31 and 32, and the pivot bolt connection 15 extends transversely through the side walls of the floating frame 11, the enlarged end portions 10*a* and 17*a* of the tension arms 10 and 17, and the tubular members 30, 31, 32.

Figure 4:
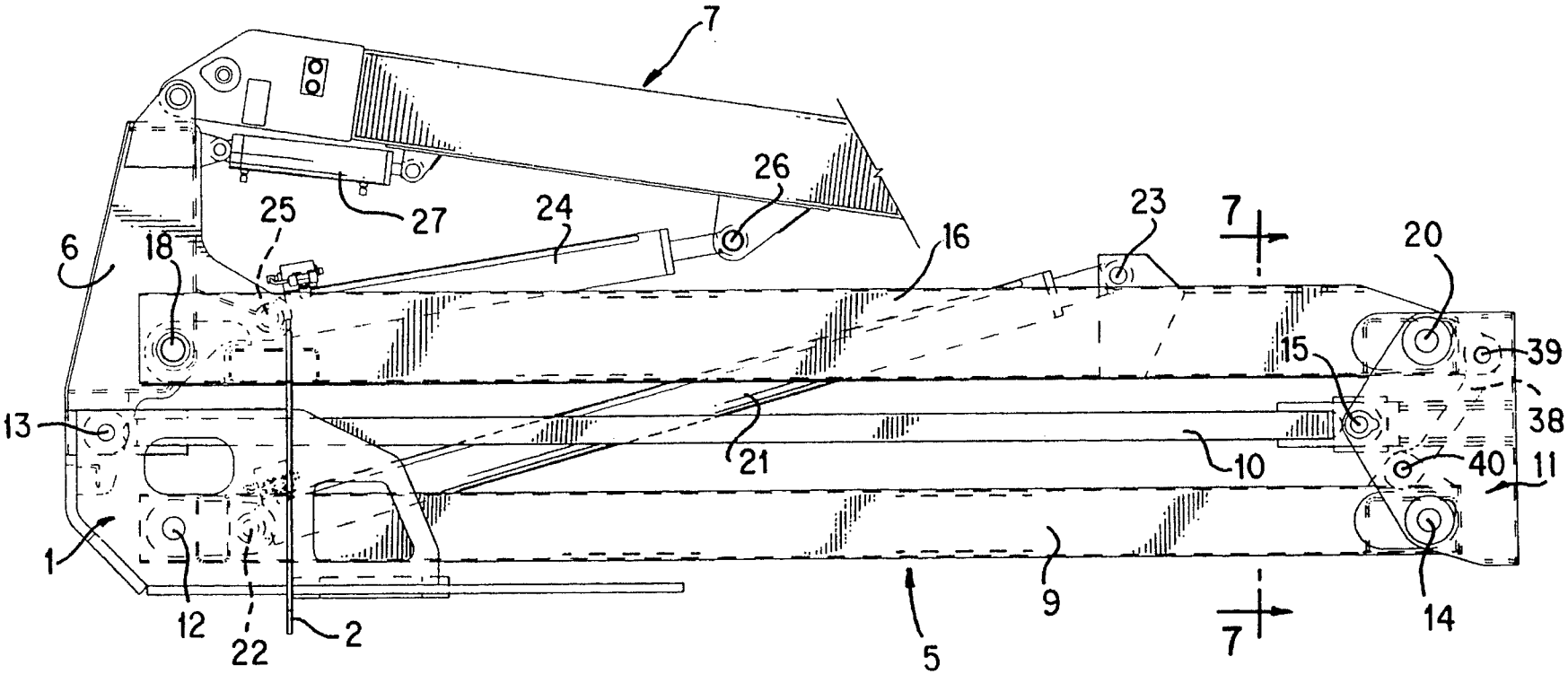
FIG. 4 is an enlarged side elevational view of the double parallelogram riser assembly in the retracted position.
Figure 5:
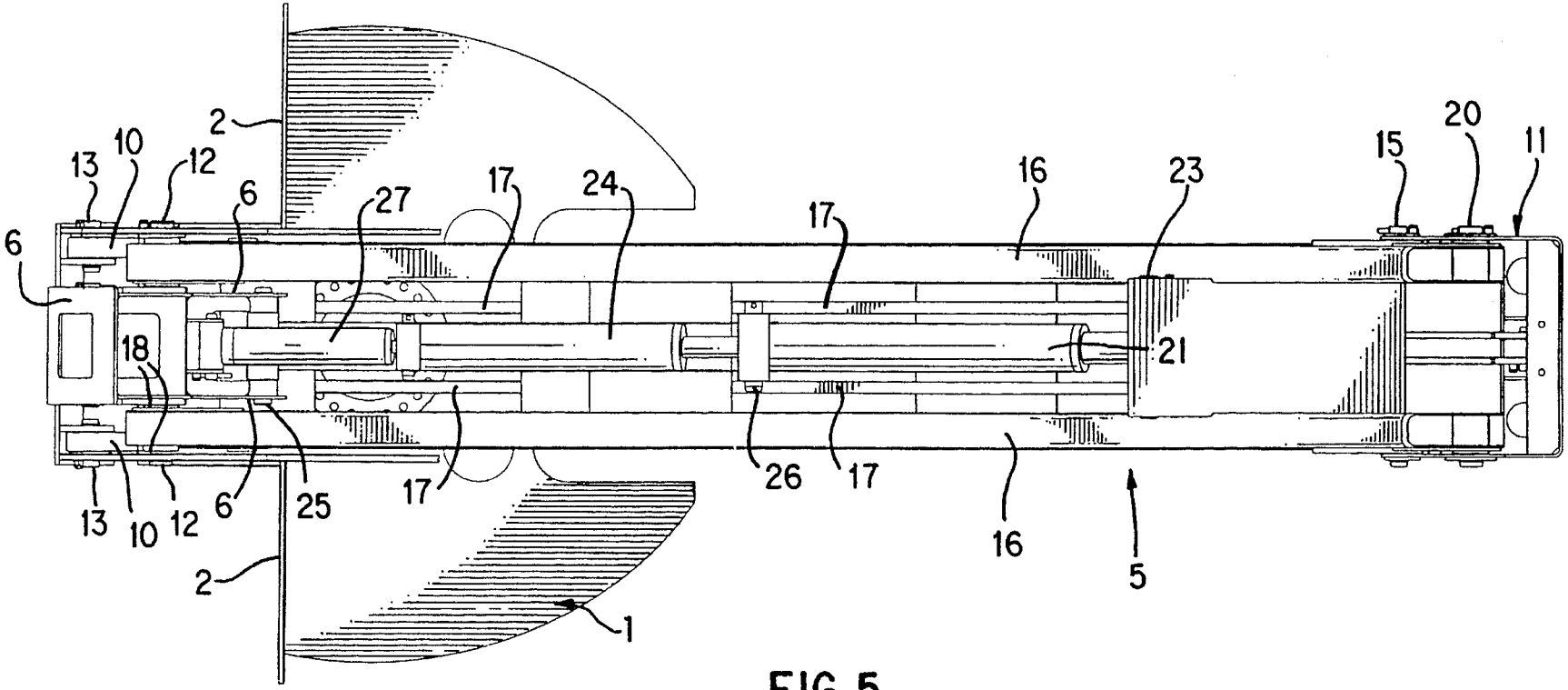
FIG. 5 is a top plan view thereof with the telescopic boom omitted for clarity.
Figure 6:
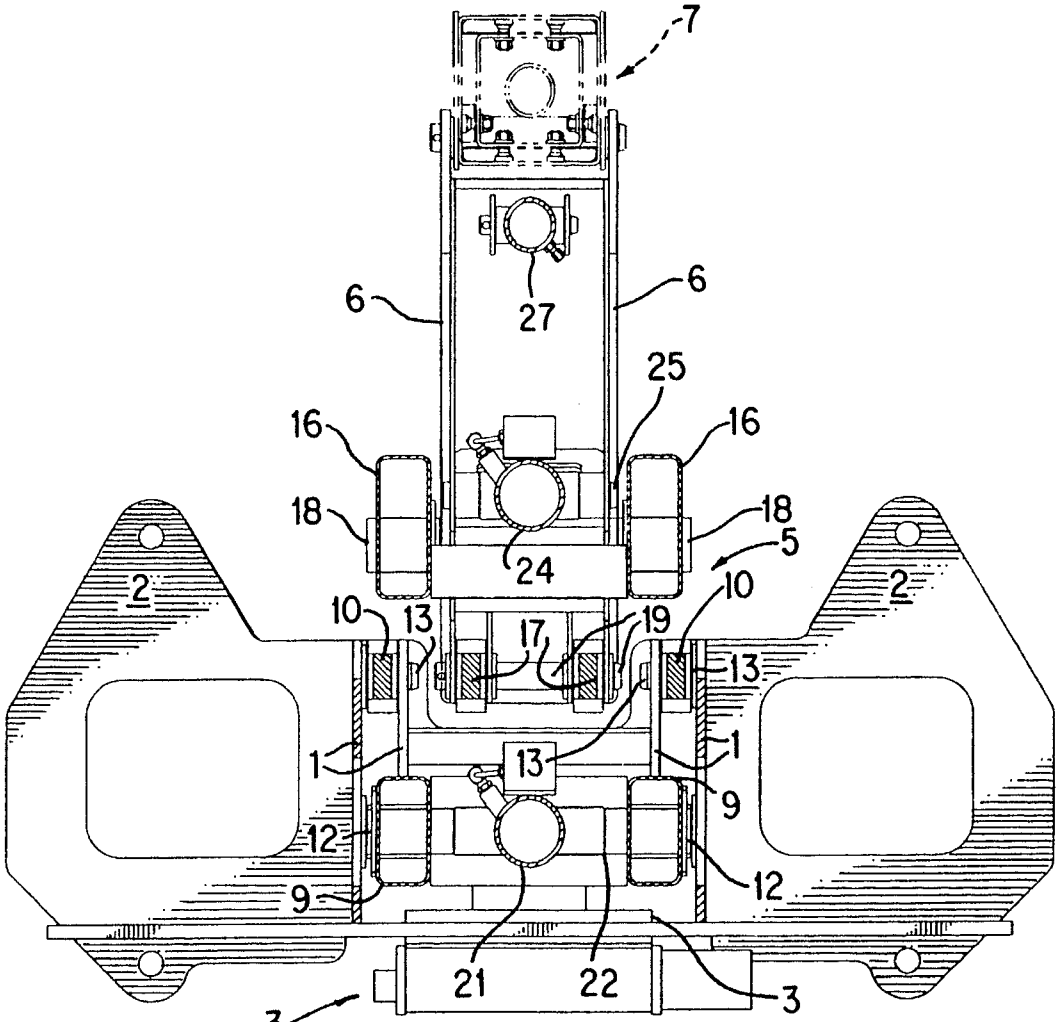
FIG. 6 is an enlarged cross sectional view similar to FIG. 3, but with parts omitted.

As shown in FIGS. 3 and 6, the opposite side plates of riser 6 are spaced apart a smaller distance than the support frame plates 1 to which the pairs of arms 9 and 10 are pivotally connected at 12 and 13, respectively. This allows the lower end of riser 6, in the retracted position of the parallelogram boom assembly 5 to extend down between support frame plates 1, as shown particularly in FIGS. 4 and 6, so that pivot connection 19 of the pair of tension arms 17 to the riser 6 is positioned in axial alignment with the pivot connections 13 of the pair of tension arms 10 to the support frame plates 1. The pair of arms 17 are connected between the side walls of riser 6 and are thus spaced apart a smaller distance than the spacing between the pair of tension arms 10, and thus lie between the pair of arms 10 in the retracted position.

The pair of compression arms 16 are pivotally connected at 18 on the outer sides of the side plates of riser 6, as shown in FIG. 6, so that the pair of arms 16, the pair of arms 10 and the pair of arms 9 are spaced apart substantially the same distance to provide a very stable parallelogram assembly, with only the pair of arms 17 being spaced apart a lesser distance than the others.

Figure 10:
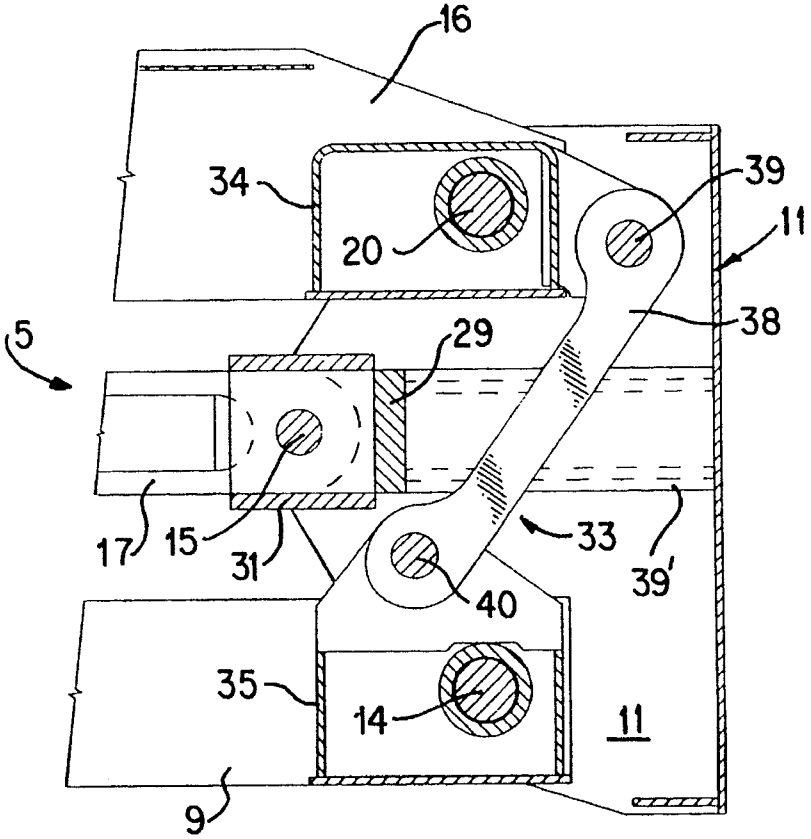
FIG. 10 is a vertical section view taken substantially along line 10—10 of FIG. 7.
Figure 9:
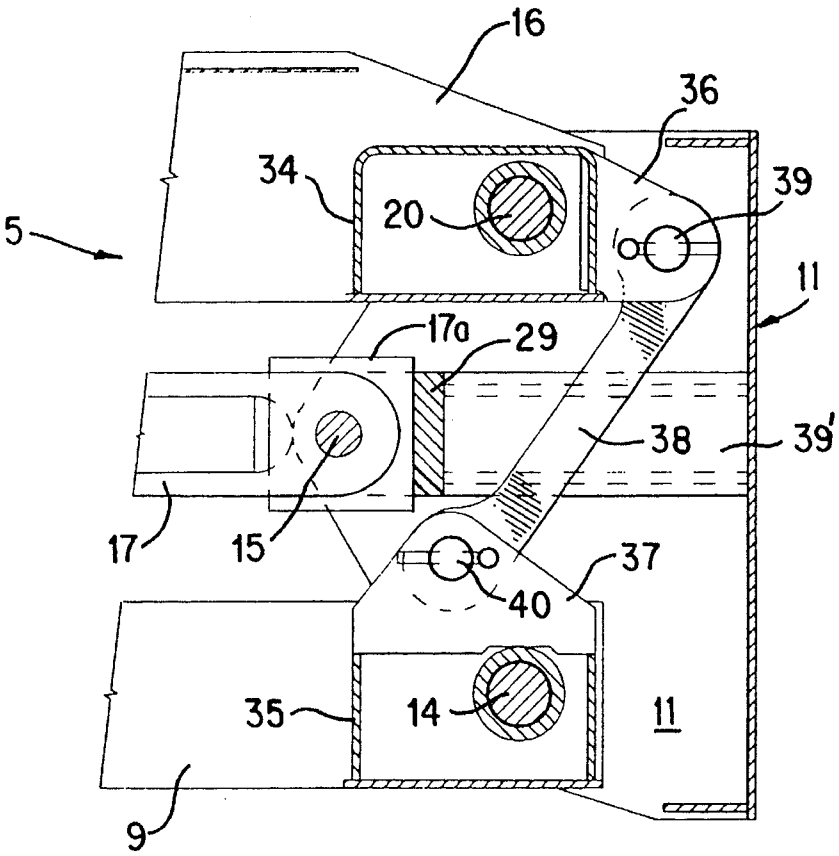
FIG. 9 is a vertical section view taken substantially along line 9—9 of FIG. 7.

As will be seen in FIGS. 7, 9 and 10, a synchronization linkage 33 is provided for maintaining the vertical orientation of the floating frame 11 during the raising and lowering of the articulated parallelogram boom assembly 5. The linkage comprises a transversely extending tubular housing 34 extending between and integral with the inner walls of the compression arms 16, through which the pivot connection bolt 20 extends. Similarly, a transversely extending housing 35 extends between and is integral with the inner walls of the compression arms 9. A pair of spaced, parallel forwardly extending ears 36 are integral with the housing 34, and a pair of spaced, parallel, upwardly extending ears 37 are integral with the housing 35. A link 38 extends between the pairs of ears 36 and 37, and its opposite end portions are positioned in the spaces therebetween and pivotally connected thereto by pins 39 and 40. By this construction and arrangement the link 38 extends diagonally relative to the pivotal connections 14 and 20, so that the link pivot connection 39 is on one side of the compression arm 16 pivot connection 20, and the link pivot connection 40 is on the other side of the compression arm 9 pivot connection 14, whereby during the actuation of the hydraulic cylinder 21 to pivot the compression arms 9 and 16 relative to each other, the link 38 will cause the floating frame 11 to remain in a vertical orientation and synchronize the movement of the upper parallelogram assembly relative to the lower parallelogram assembly.

To complete the structural description, the transverse wall 29 is reinforced by a pair of spaced, parallel reinforcing plates 39 extending between and integral with the wall 29 and front wall of the floating frame 11.

From the above description it will be readily apparent to those skilled in the art that by providing the tension arms 10 and 17 with a common pivot 15 on the floating frame 11, the pairs of arms 10 and 17 inter-digitate and lie in the same common horizontal plane when the articulated parallelogram boom assembly 5 is lowered to the folded position, whereby the low profile self propelled aerial work platform can be maneuvered in warehouses or manufacturing plants having relatively low doorways, such as, six feet, seven inches. In the lowered folded position the parallelogram boom assembly 5 lies in three closely adjacent horizontal planes, with the spaced arms 9 in the lowermost horizontal plane, parallel to the top of the superstructure horizontal plate on the turntable, the inter-digitated pairs of spaced arms 10 and 17 being in the center horizontal plane, and the spaced arms 16 being in the upper horizontal plane closely adjacent the center horizontal plane. The telescopic boom assembly 7 pivots down on top of the parallelogram boom assembly 5 in substantially a fourth plane above the upper horizontal plane, whereby the proximate end of the telescopic boom assembly adjacent its pivot connection with riser 6, is the highest point of the machine in the folded travel position, and is approximately six feet, six inches in height above the ground plane. The machine is approximately eighteen feet, eight inches in overall length, and five feet, nine inches in width which allows it to travel through standard width double doors having a six foot width. In the raised position of FIG. 2, with the telescopic boom assembly extended and elevated, the floor of the work platform 8 is approximately forty feet above the ground plane.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A low profile self propelled aerial work platform comprising, a vehicle chassis, a turntable mounted on said vehicle chassis, a superstructure support frame mounted on said turntable, an articulated parallelogram boom assembly, a riser, said articulated parallelogram boom assembly being operatively connected between said superstructure support frame and said riser, a telescopic boom assembly, one end of said telescopic boom assembly connected to said riser, and a work platform connected to the other end of said telescopic boom assembly; said articulated parallelogram boom assembly comprises, a lower boom assembly and an upper boom assembly, a floating frame connected between said upper and lower boom assembly, said lower boom assembly having a pair of parallel, laterally spaced compression arms and tension arms pivotally connected at each end to the superstructure support frame and the floating frame, respectively; the upper boom assembly having a pair of parallel, laterally spaced compression arms and tension arms pivotally connected at each end to the floating frame and said riser, respectively, the tension arms on the upper and lower boom assemblies sharing the same pivot connection on the floating frame, and a hydraulic cylinder connected between the compression arms on the lower boom assembly, and the compression arms on the upper boom assembly for elevating and folding the articulated parallelogram boom assembly, whereby when the articulated parallelogram boom assembly is lowered to the folded position, the tension arms on the upper and lower boom assemblies inter-digitate and lie in the same common plane, thereby facilitating the maneuvering of the vehicle through a low doorway.

2. A low profile self propelled aerial work platform according to claim 1, wherein the floating frame pivot connection for the tension arms on the upper boom assembly and the lower boom assembly comprises, a transversely extending plate mounted within said floating frame, a plurality of laterally spaced spacer members integral with said plate, the end portions of said tension arms extending between adjacent spacers, and a pivot bolt extending through the floating frame, spacer members, and end portions of said tension arms.

3. A low profile self propelled aerial work platform according to claim 1, wherein a synchronization linkage is mounted within the floating frame and connected between the pivotal connections of the compression arms of the upper and lower assemblies to the floating frame, whereby the floating frame is maintained in a vertical orientation during the elevating and folding of the articulated parallelogram boom assembly.

4. A low profile self propelled aerial work platform according to claim 3, wherein the synchronization linkage comprises, a first transverse housing extending between and integral with the laterally spaced compression arms on the upper boom assembly, a second transverse housing extending between and integral with the laterally spaced compression arms on the lower boom assembly, the pivotal connections for each of the compression arms to the floating frame extending transversely of the floating frame through a respective housing, and a link extending between said housings, each end of said link being pivotally connected to a respective transverse housing.

5. A low profile self propelled aerial work platform as set forth in claim 1, wherein in the folded position of the articulated parallelogram boom assembly and telescopic boom assembly the height of the folded telescopic boom assembly is less than six feet, seven inches, above the ground.

6. A low profile self propelled aerial work platform as set forth in claim 1, wherein in the folded position of the articulated parallelogram boom assembly said pairs of laterally spaced pairs of compression arms and tension arms lie in three closely adjacent horizontal planes.

7. A low profile self propelled aerial work platform as set forth in claim 6, in which said pair of parallel compression arms of said lower boom assembly lie in a lowermost horizontal plane adjacent said turntable, said pair of parallel tension arms of said lower boom assembly and said pair of parallel tension arms of said upper boom assembly lie in a center horizontal plane above said lowermost horizontal plane, and said pair of parallel compression arms of said upper boom assembly lie in an uppermost horizontal plane above said center horizontal plane.

8. A low profile self propelled aerial work platform according to claim 7, in which said hydraulic cylinder connected between said pair of compression arms on the lower boom assembly and said pair of compression arms on the upper boom assembly extend between said pair of parallel laterally spaced tension arms of said upper boom assembly.

9. A low profile self propelled aerial work platform according to claim 1, in which said pair of parallel compression arms of said lower boom assembly, said pair of parallel tension arms of said lower boom assembly, and said pair of parallel compression arms of said upper boom assembly are all laterally spaced approximately the same distance, and said pair of parallel tension arms of said upper boom assembly are laterally spaced a lesser distance than the lateral spacing of the other said pairs of arms.

10. A low profile self propelled aerial work platform according to claim 1, in which said riser has a lower end portion extendable between the superstructure support frame when the articulated parallelogram boom assembly is lowered to the folded position, said pair of parallel laterally spaced tension arms of said upper boom assembly pivotally connected to said lower end portion of said riser, and in the folded position said pivotal connection of said pair of parallel laterally spaced tension arms of said upper boom assembly to said lower end portion of said riser being in axial alignment with the pivotal connection of said pair of parallel laterally spaced tension arms of said lower boom assembly to said superstructure support frame.

11. A low profile self propelled aerial work platform according to claim 10, in which said lower end portion of said riser includes a pair of laterally spaced side plates, said pair of parallel tension arms of said upper boom assembly pivotally connected between said pair of laterally spaced side plates of said riser, and said pair of parallel compression arms of said upper boom assembly pivotally connected to and outwardly of said pair of laterally spaced side plates of said riser frame.

* * * * *